US009222628B2

(12) United States Patent
Li et al.

(10) Patent No.: US 9,222,628 B2
(45) Date of Patent: Dec. 29, 2015

(54) COLOR TEMPERATURE TUNABLE LED-BASED LAMP MODULE

(71) Applicant: Excelitas Technologies Corp., Waltham, MA (US)

(72) Inventors: Wei Li, South Barrington, IL (US); Sergey Kudaev, Ingolstadt (DE); Mikhail Melnik, Glenview, IL (US); Wai Choi, Schaumburg, IL (US); Robert Olma, Schaumburg, IL (US)

(73) Assignee: Excelitas Technologies Corp., Waltham, MA (US)

( * ) Notice: Subject to any disclaimer, the term of this patent is extended or adjusted under 35 U.S.C. 154(b) by 126 days.

(21) Appl. No.: 13/886,703

(22) Filed: May 3, 2013

(65) Prior Publication Data

US 2013/0294103 A1 Nov. 7, 2013

Related U.S. Application Data

(60) Provisional application No. 61/642,906, filed on May 4, 2012.

(51) Int. Cl.

| | |
|---|---|
| ***F21K 99/00*** | (2010.01) |
| ***F21V 33/00*** | (2006.01) |
| ***F21V 7/00*** | (2006.01) |

(Continued)

(52) U.S. Cl.

CPC ..... *F21K 9/54* (2013.01); *F21V 7/0008* (2013.01); *F21V 7/0033* (2013.01); *F21V 33/0068* (2013.01); *F21V 2200/00* (2015.01);

(Continued)

(58) Field of Classification Search

USPC ..... 362/555, 297, 298, 299, 302, 307

See application file for complete search history.

(56) References Cited

U.S. PATENT DOCUMENTS 3,772,506 A 11/1973 Junginger
5,278,731 A * 1/1994 Davenport et al. ..... 362/551

(Continued)

FOREIGN PATENT DOCUMENTS

EP 1389710 A2 2/2004
EP 1610054 A2 12/2005

(Continued)

OTHER PUBLICATIONS

OPTA Technology, Inc. 160 E. Marquardt Drive, Wheeling IL 60090, Product Sheet for Multi-Wavelength Illuminator OTLA-0130; Jan. 28, 2009, pp. 1-3.

(Continued)

*Primary Examiner* — Laura Tso

(74) *Attorney, Agent, or Firm* — Peter A. Nieves; Sheehan Phinney Bass + Green

(57) ABSTRACT

A light mixing and folding lamp includes an LED assembly with two or more LED chips that direct light into the ingress end of a light mixing rod. The light mixing rod is positioned to pass through an aperture in a concave second reflecting element, and mixed light emerges from the egress end of the light mixing rod, where it is directed toward a first reflecting element positioned near a focal point of the second reflecting element. The first reflecting element reflects mixed light emerging from the egress end of the light mixing rod, folding the mixed light back toward a concave reflecting surface of the second reflecting element. The second reflecting element reflects light from the first reflecting element forward, where the light emerges from the lamp directed toward a subject to be illuminated.

22 Claims, 8 Drawing Sheets

(51) Int. Cl.

| | |
|---|---|
| *F21W 131/202* | (2006.01) |
| *F21Y 101/02* | (2006.01) |
| *F21Y 113/00* | (2006.01) |

(52) U.S. Cl.
CPC ..... *F21W2131/202* (2013.01); *F21Y 2101/02* (2013.01); *F21Y 2113/005* (2013.01)

(56) References Cited

U.S. PATENT DOCUMENTS

| | | | | |
|---|---|---|---|---|
| 5,438,485 | A * | 8/1995 | Li et al. | 362/558 |
| 5,725,296 | A * | 3/1998 | Bibbiani et al. | 362/560 |
| 6,991,355 | B1 * | 1/2006 | Coushaine et al. | 362/555 |
| 7,275,849 | B2 * | 10/2007 | Chinniah et al. | 362/555 |
| 7,777,955 | B2 | 8/2010 | Cassarly et al. | |
| 8,016,470 | B2 | 9/2011 | Li et al. | |
| 8,388,205 | B2 | 3/2013 | Swayne et al. | |
| 2004/0208019 | A1 * | 10/2004 | Koizumi et al. | 362/545 |
| 2009/0091913 | A1 | 4/2009 | Li et al. | |
| 2009/0231878 | A1 * | 9/2009 | Van Duijneveldt | 362/555 |
| 2012/0267495 | A1 | 10/2012 | Olma et al. | |

FOREIGN PATENT DOCUMENTS

| | | | |
|---|---|---|---|
| EP | 2166580 | A1 | 3/2010 |
| EP | 2211089 | A1 | 7/2010 |
| WO | 2011156645 | A1 | 12/2011 |

OTHER PUBLICATIONS

Excelitas Technologies LED Solutions, 160 E. Marquardt Drive, Wheeling, IL 60090, Product Sheet for LED Dental Lamp, OTLH-0585, Pelton & Crane p/n 053218, 2008, pp. 1-8.

Excelitas Technologies Corp., 200 West Street, Suite E403 Waltham MA 02451, Product Sheet for OTFI-0250, XLM LED Fiber Optic Light Module, 2010, pp. 1-4.

OPTA Technology, Inc., E. Marquardt Drive, Wheeling IL 60090, Product Sheet for Endura Bright Series, OT16-3X01-XX-13 Data Sheet Rev. F, 2005, pp. 1-3.

* cited by examiner

COLOR TEMPERATURE TUNABLE LED-BASED LAMP MODULE

CROSS-REFERENCE TO RELATED APPLICATIONS

This application claims the benefit of U.S. Provisional Patent Application Ser. No. 61/642,906, filed May 4, 2012, entitled "COLOR TEMPERATURE TUNABLE LED-BASED LAMP MODULE," which is incorporated by reference herein in its entirety.

FIELD OF THE INVENTION

The present invention relates to lighting equipment, and more particularly, is related to a lamp module.

BACKGROUND OF THE INVENTION

Electrically powered incandescent lights are well known. However, such incandescent lights suffer from an inefficient conversion of electricity to visible light, using excess energy, producing excessive heat, and emitting significant amounts of radiation in, or near, the infrared spectrum. Therefore, the subject being illuminated is often heated as well as illuminated, particularly with high intensity incandescent lights. The heat generated by incandescent lighting may burden environmental control systems, such as air conditioning systems. The combination of inefficient light generation and excess heat generation may lead to higher operating costs, for example, unnecessarily large electric utility bills. In addition to excess power use, using such lights in operatory to illuminate a patient, may result in heating and drying illuminated tissue, causing discomfort to the patient.

More recent alternatives to incandescent light emitting elements include fluorescent light bulbs, which generate less heat than incandescent bulbs. However, fluorescent bulbs tend to be bulky and generally produce light of a less desirable color and intensity for many applications. In addition, the electrical components of fluorescent bulb circuitry, such as the ballast, tend to be bulky and produce undesirable noise. In use in an operatory, it is generally desirable to reduce the bulk of a lamp fixture, to reduce its intrusion into the operating arena, and to facilitate ease of manipulation of the lamp fixture.

Most dental exam lights use incandescent bulbs as light sources, and therefore produce some or all of the undesirable side effects described above. While some of these lights have been designed to mitigate some of these disadvantages, such as filtering emission of infra-red (IR) or providing cold-mirrors to prevent excessive warming of the patient and user, they still suffer from, for example, relatively short bulb life-time, inability of the user to adjust light color temperature and chromaticity of light, color temperature becoming lower and the light becoming "warmer" (shifting from white to orange/red) when light intensity is reduced (dimmed), and production of significant ultraviolet (UV) and blue light which may cause undesired and uncontrolled curing of dental composites and adhesives.

More recently, light emitting diode (LED) based dental exam lights have been introduced, for example, U.S. Pat. No. 8,016,470, herein incorporated by reference in its entirety. A lamp according to U.S. Pat. No. 8,016,470 is shown by FIG. 1. The lamp 100 is powered by electricity, and functions to provide illumination to a work area disposed a distance from the lamp front 102. The lamp 100 may include an attachment structure (not shown) connecting the lamp 100 to a suspension structure (not shown) in the work area. Such an attachment structure is typically attached at a back 106 of the lamp 100. A typical suspension structure (not shown) in a dental operatory permits a user to orient the lamp 100 in space operably to aim the light output of lamp 100 at the desired target area. Optional attachments, such as a shield (not shown), or a portion of a lamp base (not shown), can be hinged, or otherwise openable by a user, to provide access to the interior of lamp 100 for maintenance or replacement of a light generating element, for example, an LED 118.

A reflecting element 116 directs the light of the LED 118 output toward a target. The reflecting element 116 is a concave aspheric reflector which collects the light emanating from a light mixing rod 136 secured in place by a rod support 138 and focuses the collected light onto the plane of the patient's face ("image plane"). The LEDs 118 are mounted onto a bracket 112 associated with a lamp housing 114. The bracket 112 assembly includes connection structure for the electricity supplied to the LED 118 and may further include a metal core circuit board 130. The bracket 112 is formed from a heat conducting material and further dissipates heat with heat conducting pipes 134, heat sink fins 142, and via convection through a gap 144 between the reflecting element 116 and the heat sink 142.

While the prior art LED dental lamps improve upon some aspects of incandescent lamps, the positioning of the LED and associated circuitry at the lamp front still presents problems. For example, the LED assembly may block light from the reflector. Further, this configuration places the hot LED assembly at the portion of the lamp that is closest to the patient, and requires additional design and materials to conduct the heat away from the patient. In addition, the arrangement necessitates electrical connectivity to the LED assembly at the lamp front. Finally, the location of the LED assembly and associated heat and electrical conduits in the lamp front may result in additional size and weight of the lamp. Therefore, there is a need in the industry for an LED dental lamp that addresses the above shortcomings.

SUMMARY OF THE INVENTION

Embodiments of the present invention provide a color temperature tunable LED based lamp module. Briefly described, the present invention is directed to a lighting device for illuminating a target subject having a light guide with an ingress end having a first shape and an egress end having a second shape, a lamp having a plurality of light sources in optical communication with the light guide ingress end, a first reflector with a first diameter in optical communication with the light guide egress end, and a second reflector with a second diameter in optical communication with the first reflector. The light guide egress end is disposed substantially between the first reflector and the second reflector.

A second aspect of the present invention is directed to a method for mixing and folding light from a plurality of light sources including the steps of generating a first light beam from a first light source and a second light beam from a second light source, mixing the first light beam and the second light beam in a light mixing rod to produce a mixed light beam, reflecting the mixed light beam by a first reflector toward a second reflector as a first reflected light beam, and reflecting the first reflected light beam by the second reflector as a second reflected light beam.

Briefly described, in architecture, a third aspect of the present invention is directed to an array lamp including a plurality of lamp modules. Each lamp module further includes a light mixing rod with an ingress end and an egress end, a lamp having a plurality of LEDs in optical communication with the light mixing rod ingress end, a first reflector in optical communication with the light mixing rod egress end, and a second reflector in optical communication with the first reflector. The light mixing rod egress end is disposed substantially between the first reflector and the second reflector.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

As used within the claims and specification herein, the term "optical communication" between a first object and a second object refers to a clear optical path between the two objects, for example, for a light beam to traverse a substantially unimpeded path from the first object to the second object.

As used within the claims and specification herein, the term "light source" refers to an element producing electromagnetic radiation, typically, but not limited to the visible light spectrum. Examples of light sources include, but are not limited to as an incandescent light bulb, a fluorescent light, or an LED. A lamp module may include one or more light sources.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principals of the invention.

DETAILED DESCRIPTION

Figure 1:
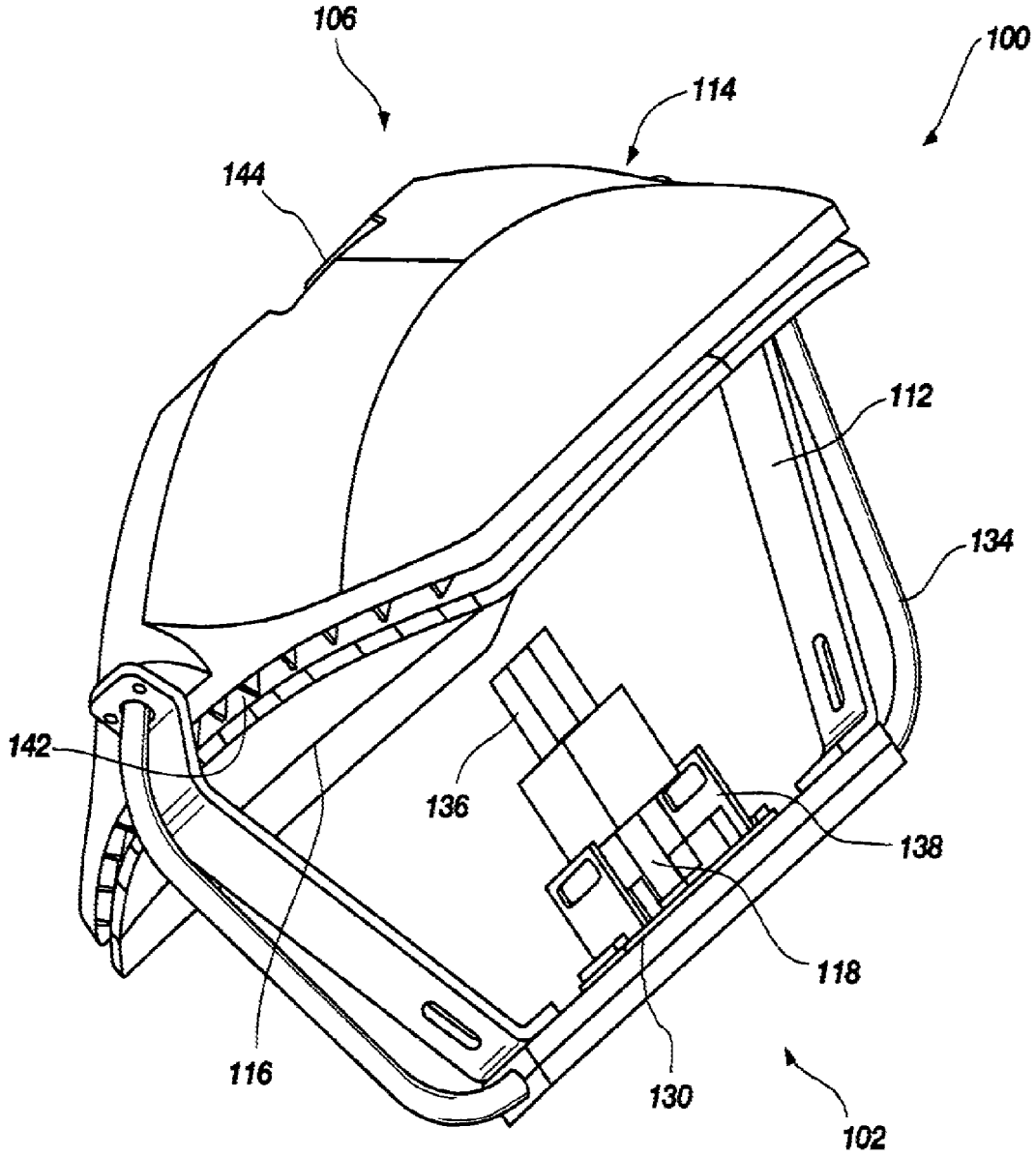
FIG. 1 (PRIOR ART)
FIG. 1 is a perspective view of a prior art dental operatory lamp.

Reference will now be made in detail to embodiments of the present invention, examples of which are illustrated in the accompanying drawings. Wherever possible, the same reference numbers are used in the drawings and the description to refer to the same or like parts.

An exemplary embodiment of a lamp includes an LED assembly with two or more LED chips that direct light into an ingress end of a light mixing rod. The light mixing rod is held in place so it is positioned through an aperture in a concave shaped second reflecting element. Mixed light emerges from an egress end of the light mixing rod, where it is directed toward a first reflecting element positioned near a focal point of the second reflecting element. The first reflecting element reflects mixed light emerging from the egress end of the light mixing rod back toward a concave reflecting surface of the second reflecting element, where the light is reflected forward and emerges from the lamp directed toward a subject to be illuminated.

Figure 2:
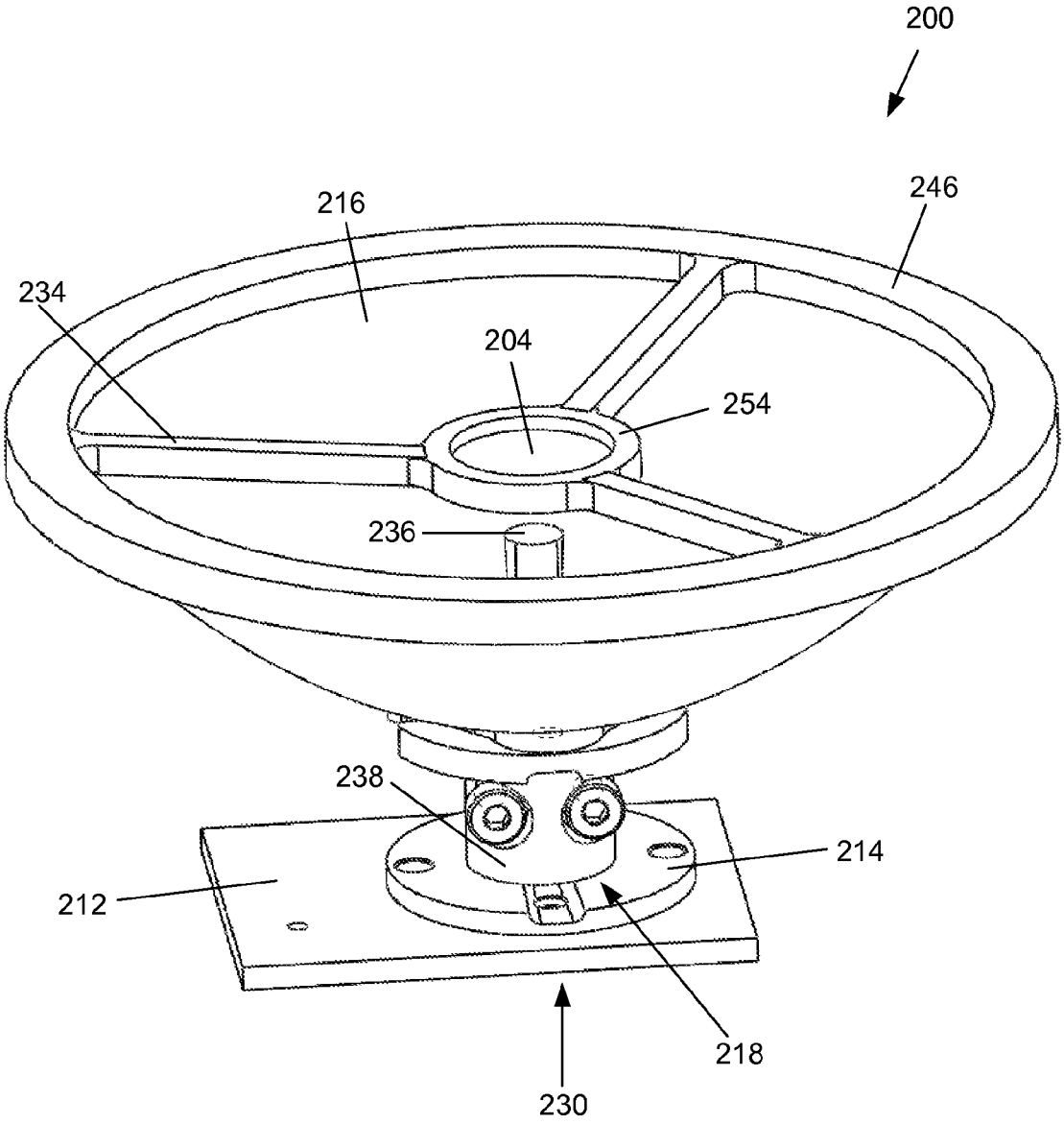
FIG. 2 is a schematic diagram of an exemplary first embodiment of a lamp.

A schematic diagram of an exemplary first embodiment of a lamp 200 is shown in FIG. 2. An assembly of two or more LEDs 218 is typically mounted onto a bracket 212 associated with a lamp base 214. Desirably, the bracket 212 assembly is structured to provide simple and rapid installation and removal of the LED 218, and includes connection structure for the electricity supplied to the LEDs 218 and may further include a metal core circuit board 230. It is further desirable for the bracket 212 to be formed from a material capable of conducting heat and/or to be associated with a heat sink (not shown). The bracket 212 may be advantageously structured and arranged to dissipate any heat generated by the LED 218 in a direction away from the front of the lamp 200.

In order to produce homogenous light from multiple LEDs 218 of different colors (for example, but not limited to red, greed, blue, and amber), the light emitting from each individual LED should sufficiently overlap the light from all the other LEDs 218. In the first embodiment, a clear rectangular rod 236 made of acrylic serves this function and is referred to herein as an optical light guide or a light mixing rod 236. It is understood that the mixing rod 236 can be made out of any suitable material capable of acting as an optical light guide. The performance of the mixing rod 236 can be significantly enhanced with the addition of periodic features or "ripples" (not shown) on the outside walls of the mixing rod.

Figure 3A:
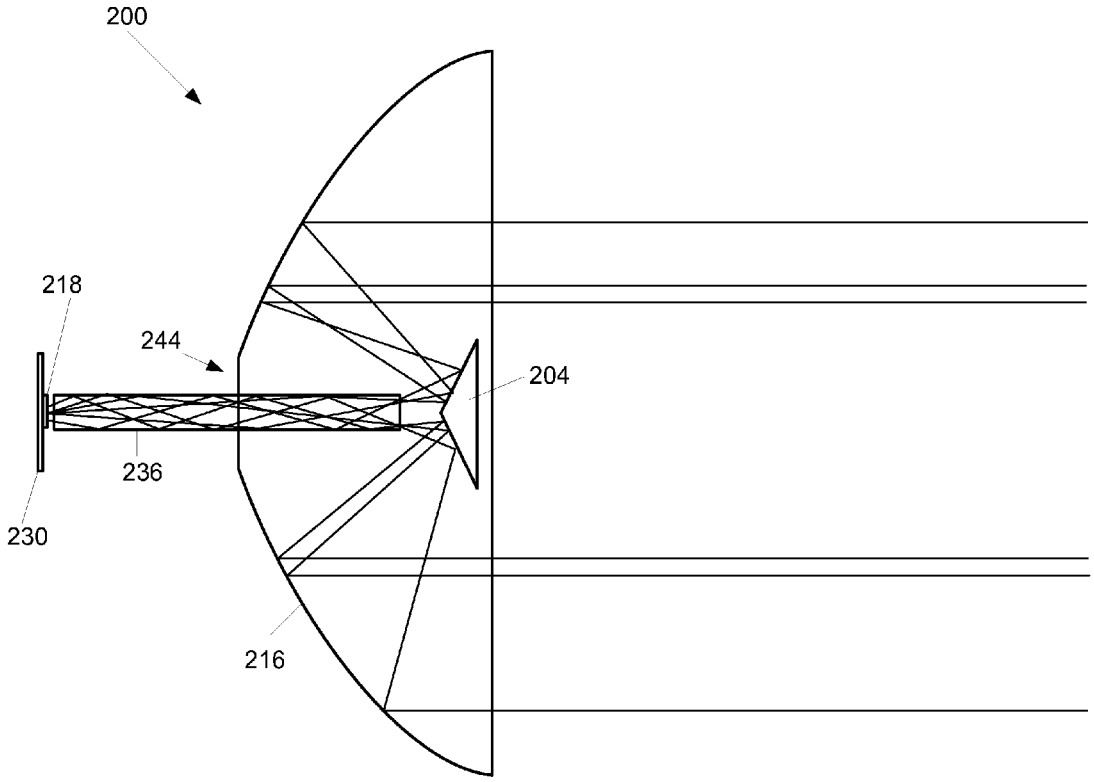
FIG. 3A is a diagram indicating multiple light paths in the lamp.

As illustrated in FIG. 3A, light from multiple LEDs 218 of different colors (for example, but not limited to red, green, blue, and/or amber) is introduced through an ingress end of the mixing rod 236 and emanate from an egress end of the mixing rod 236 as a composite white light. For example, the light from four different colored LEDs 218 (red, blue, green, and amber), as mixed by the mixing rod 236, may produce white light. Of course, the number of LED chips in the LED 218 is not limited to four. Configurations of LED assemblies having one, two, three, five, or more of LED chips are also possible.

By varying the ratios of the different colors, the character of the white light can be changed. Specifically, white light with coordinated color temperatures (CCTs) of 4200° K and 5000° K can be produced while maintaining a high color rendering index (CRI), typically in excess of 75. Blue light typically occurs in the peak wavelength range of 445 nm to 465 nm. Green light typically occurs in the dominant wavelength range of 520 nm to 550 nm, amber light in the range of 584 nm to 597 nm, and red light in the range of 613 nm to 645 nm. A holder 238 (FIG. 2) may be used to secure mixing rod 236 in place.

Multiple LEDs of separate colors can be mounted on the circuit board 230 using reflow surface mount techniques to achieve optimum optical density. For example, a conventional metal core board (MCB) 230 can be used. Alternatively, a conventional fiberglass laminate (FR4) printed circuit board (PCB) material can be used. LEDs, particularly red and amber LEDs, generally have the characteristic that their light output decreases significantly as their temperature raises. Heat management can be critical to maintaining optimum light output and therefore the proper ratios of light intensity to maintain the desired CCT and CRI.

The light from the LEDs 218 is directed into an ingress end of the light mixing rod 236, where the different colored lights are mixed and emerge from an egress end of the light mixing rod 236. A first reflecting element 204 receives light rays emanating from the egress end of the mixing rod 236 and reflects the light rays toward a second reflecting element 216. In the first embodiment, the first reflecting element 204 has a reflecting surface with a substantially convex contour, thereby dispersing the light rays in a wide dispersion pattern.

Typically, the second reflecting element 216 is configured to direct the light produced by the LED 218 and reflected by the first reflecting element 204 toward a target, for example, the face of a patient. For example, the light reflected by the second reflector element 216 may be directed substantially in a similar direction to the general direction of mixed light emerging from the light mixing rod 236. In the first embodiment, the second reflecting element 216 is a concave aspheric reflector which collects the light reflected by the first reflecting element 204 and focuses it onto the plane of the face of the patient ("image plane"). The contour surface of the second reflecting element 216 may be aspherical, for example, a simple 2D ellipse section revolved around the central optical axis, or a parabolic curve. Preferably, the first reflecting element 204 is positioned between the second reflecting element 216 and an optical focal point of the second reflecting element 216.

Figure 3B:
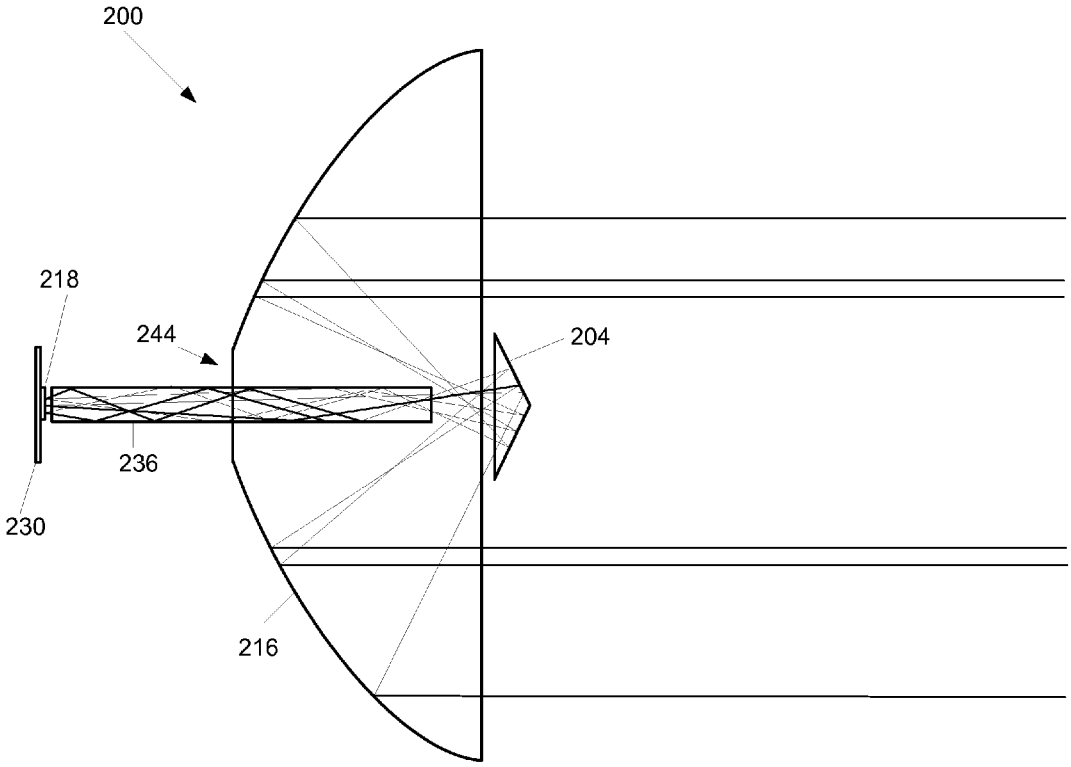
FIG. 3B is a diagram indicating multiple light paths in an alternative embodiment of a lamp.

In an alternative embodiment as shown in FIG. 3B, the first reflecting element 204 has a concave contour and is positioned beyond the focal point of the second reflecting element 216. Of course, besides being concave or convex, the first reflecting element 204 may also be flat. The first reflecting element 204 may be located in front of, behind, or at the focal point of the second reflecting element 216.

While the first reflecting element 204 and the second reflecting element 216 are depicted as having substantially smooth reflective surfaces, there is no objection to the reflective surface of the first reflecting element 204 being irregular, and/or the reflective surface of the second reflecting element 216 being irregular. For example, the reflective surface may be faceted, rippled, have multiple dimples or flat hammer spots. The irregular reflective surface may contribute to further mixing and/or dispersing of light rays. For example, a faceted reflector 204, 216 may improve the mixed color and intensity uniformity.

The mixed light reflected by the first reflecting element 204 can be directed toward the curved or faceted interior reflective surface of the second reflecting element 216 for directing the light from the LEDs toward the front of the lamp 200 in a pattern that focuses light from the lamp to a central area of illumination of high intensity, with significantly reduced intensity illumination outside the central area. The reduced intensity illumination outside the central area can be configured to decrease in intensity, for example, by 50% of a maximum intensity relative to the central area of illumination of high intensity. The reduced intensity illumination outside the central area may be configured to decrease in intensity progressively and smoothly relative to the central area of illumination of high intensity. The light pattern can have a brightness of greater than about 20,000 Lux at a focus height of 700 mm from a target. The illumination on the central area of illumination of high intensity at a distance of 60 mm may be less than about 1200 Lux. The illumination at the maximum level of the dental operating light in the spectral region of 180 nm to 400 nm may be configured to not exceed 0.008 $W/m^2$.

Returning to FIG. 2, the first reflecting element 204 may be held in place relative to the light mixing rod 236 and the second reflecting element 216 with a first reflector support 234. The first reflector support 234 includes three spanning beams between a first reflector collar 254 and a second reflector collar 246. Of course, the first reflector support 234 may include 1, 2, 4, or more supports, or may hold the first reflecting element 204 in place by other means known to a person having ordinary skill in the art, for example, by a transparent shield made from glass or plastic spanning between the first reflector collar 254 and the second reflector collar 246. While the first reflector support 234 of FIG. 2 holds the first reflector element 204 at a fixed distance from the second reflector element 216 and the light mixing rod 236, there is no objection to a first reflector support 234 where the distance stance from the second reflector element 216 and/or the light mixing rod 236 is variable, for example, to change the light dispersion pattern of the lamp 200. Similarly, the holder 238 may be adjusted to change the position of the mixing rod 236 in relation to the first reflecting element 204.

As shown by FIG. 3A, the second reflector element 216 has an aperture 244 substantially at the center of the second reflector element 216. The light mixing rod 236 passes through the aperture 244, so that the LEDs 218 and ingress end of the light mixing rod 236 are located substantially outside the concave contour of the second reflector element 216, while the egress end of the light mixing rod 236 is located substantially inside the concave contour of the second reflector element 216. Such an arrangement may be advantageous over the prior art, as the heat produced by the LEDs 218 is generated at the rear of the lamp 200, further away from the subject being illuminated than, for example, the prior art illustrated in FIG. 1. In addition, since the heat from the LEDs 218 is produced outside the reflecting elements 204, 216, it may be more easily conveyed away from the lamp 200 and the subject, for example, via conduction or convection methods known to persons having ordinary skill in the art.

In an alternative embodiment, the second reflector element 216 may not have an aperture 244, so that LEDs 218, the ingress end of the light mixing rod 236, and the egress end of the light mixing rod 236 are located substantially inside the concave contour of the second reflector element 216.

Another advantage of the lamp 200 over the prior art is that a smaller lamp 200 may provide a similar amount and intensity of light than the prior art, due to the light being folded (reflected) by the first reflecting element 204 between the light mixing rod 236 and the second reflecting element 216, allowing for the same distance of light travel as the prior art in a smaller lamp 200.

Lenses may be employed in the light path for improved color and intensity uniformity. For example, a first lens (not shown) may be positioned between the LEDs 218 and the ingress end of the light mixing rod 236. Similarly, a second lens (not shown) may be positioned between the egress end of the light mixing rod 236 and the first reflecting element 204. Embodiments may include the first lens, and/or the second lens.

The function of the LEDs 218 may be controlled by circuitry, for example, a processor or computer which may be mounted on the circuit board 230, or may be remotely located and in wired or wireless communication with the circuit board 230.

The ratio of the various LED colors may be controlled (for example, dimmed) with a variation of pulsed width modulation (PWM) of a supplied current, for example, to individual LED chips or groups of LED chips. During the assembly and test of the lamp 200, each color may be independently characterized for peak wavelength, spectral spread (full width half max), and illuminance (lux) at the image plane at a predetermined maximum current. Using test software based on both theoretical and empirical predictions, these values are used to generate a table of duty cycles for each wavelength at each of the three operating conditions: 4200K, 5000K, and "No Cure" modes at start up (board temperature equal to ambient temperature). These tables then can be stored on an electronic memory device (chip), for example, that matches the serial number of the lamp. A PWM controller then looks up the duty cycle table on the memory chip and sets the duty cycles accordingly when the lamp is first started. At this time, the test software algorithm can also produce and store duty cycle tables for the full range of operating board temperatures.

In an alternative embodiment, temperature compensation or measurement may be included. Since each color LED has a different sensitivity to heat, a compensation algorithm can be used to set the drive current values for each color as a function of temperature. The compensation algorithm may be adapted to assume that LEDs of a given color do not exhibit significant differences in temperature sensitivity. As a result, each lamp need not be characterized thermally but rather may depend on the theoretical and empirically determined temperature relationships in the algorithm. A thermistor on the LED circuit board may also be included to measure actual board temperature from which the LED temperature can be derived, based on previously determined empirical values, and the current to each LED color can be adjusted accordingly by software.

The lamp 200 may allow the user to set various chromaticity settings, such as sunlight equivalent D65 or simulated fluorescent lighting for improved dental shade matching. It also control the addition of thermal, color, or intensity feedback to better maintain light characteristics over the life of the product, and permits adjustment of light intensity independent of color setting. The lamp 200 may be adapted to provide different configurations and forms of color mixing light guides. Specifically, the lamp 200 may provide a user selectable mode with reduced irradiance in the near UV and blue wavelengths to allow adequate illumination while not initiating curing of UV-curable dental composites and adhesives. The lamp design can provide longer life through use of LEDs instead of incandescent bulbs and use of heat dissipation to maintain low LED temperature even at high currents.

Figure 4A:
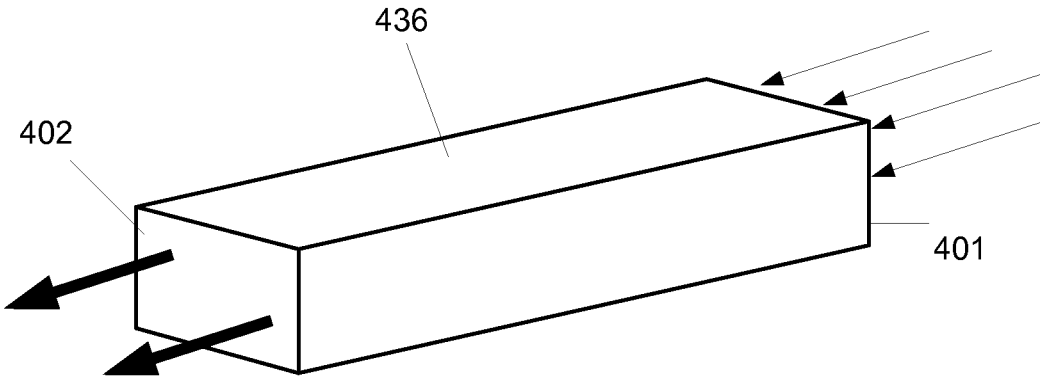
FIG. 4A is a schematic diagram of a first embodiment of a mixing rod.
Figure 4B:
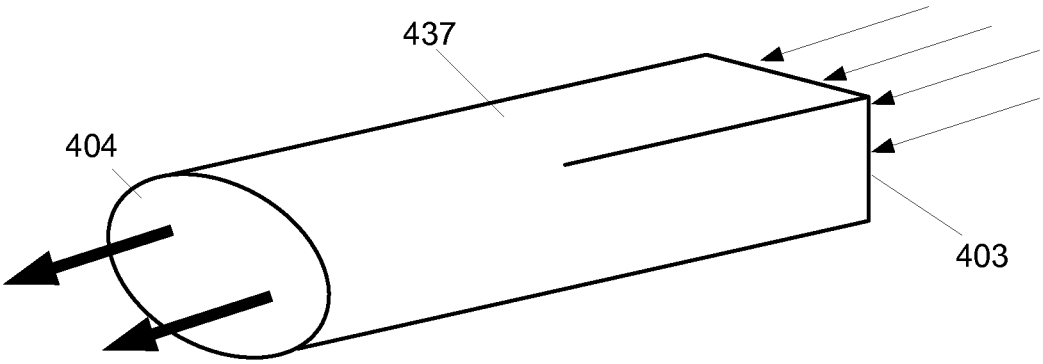
FIG. 4B is a schematic diagram of a second embodiment of a mixing rod.

The input surface of the light mixing rod 236 can match the shape and size of the LEDs 218 to maximize the light collection. For example, as shown in FIG. 4A, a first light rod 436 may have an ingress end 401 having a substantially rectangular shaped cross section, for example, corresponding to a substantially rectangular arrangement of LEDs 218. An egress end 402 of the first light rod 436 surface of the first light rod 436 can keep the shape and size of the ingress end 401, as shown in FIG. 4A. Alternatively, as shown in FIG. 4B, a second light rod 437 may have an ingress end 403 having a first shape, for example, rectangular, and an egress end 404 having a different shape, circular, for example, or size. The egress end 404 surface becomes the source object for the first reflecting element 204 (FIG. 2), and the second reflecting element 216 (FIG. 2) thereafter. Since the final image has substantially the same shape of the egress end of the light rod 436, 437, the projected beam may be manipulated in shape by changing shape of the egress end of the light rod 436, 437.

A number of lamp modules can be arrayed into any lamps for many applications, not limited to, for example, surgical lamps and/or exam lights. Under the first embodiment, described above, a lamp may include a single lamp module having at least one light source, a light mixing rod, a first reflector and a second reflector. In a second embodiment of the present invention, a lamp includes an array of two or more lamp modules. Under the second embodiment, identical lamp modules may be used to form a complete lamp. Alternatively, an array of modules with different elements such as LEDs or reflectors may be used to form a complete lamp.

Figure 5A:
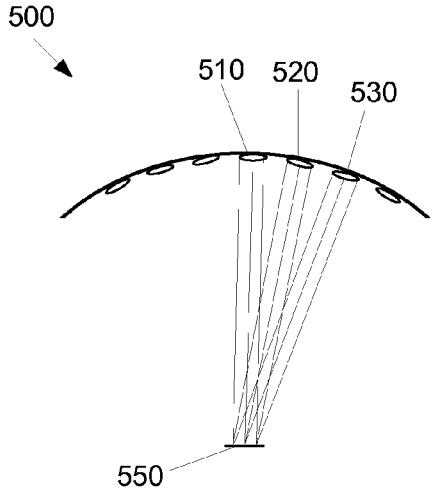
FIG. 5A (PRIOR ART)
FIGS. 5A and 5B are schematic diagrams of a prior art array lamp.
Figure 5B:
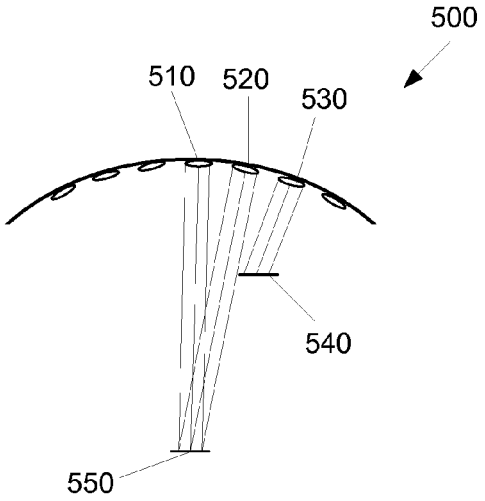
FIG. 5B (PRIOR ART)

FIG. 5A shows a prior art array lamp 500 having a blue lighting element 510, a red lighting element 520, and a green lighting element 530. The array is configured to direct each of the lighting elements 510, 520, 530 to an image plane 550, where the blue, green, and red light is combined to form white light. A disadvantage to this configuration is apparent when, as in FIG. 5B, a mask 540 blocks one or more of the lighting elements 510, 520, 530, for example, the green lighting element 530. In this case, only blue and red light from lighting elements 510 and 520 is combined at the image plane 550, resulting in a non-white light at the image plane. The mask may be, for example, the head of a surgeon blocking one or more lighting elements from reaching the image plane, for example, a patient on an operating table.

Figure 6A:
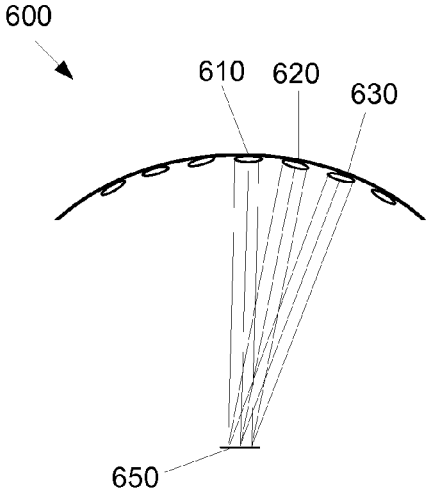
FIGS. 6A and 6B are schematic diagrams of a second embodiment of a lamp.
Figure 6B:
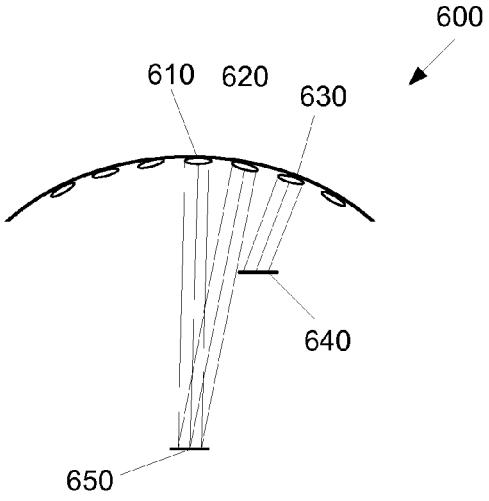

FIG. 6A shows an array lamp 600 in a second exemplary embodiment of the present invention. The array lamp 600 includes a first lamp module 610, a second lamp module 620, and a third lamp module 630, where each lamp module is according to the first embodiment, producing white light directed to an image plane 650. In contrast with the prior art of FIGS. 5A and 5B, if a mask 640 blocks one or more of the lamp modules 610, 620, 630, for example, the third lighting element 630 as shown in FIG. 6B, the light color at the image plane 650 will still be substantially unchanged, albeit with somewhat reduced intensity. This is clearly advantageous to the prior art, as the color at the image plane 650 does not change if/when one or more lamp modules 610, 620, 630 is masked. While examples shown in FIGS. 6A and 6B have three active lamp modules, there is no objection to having two, four, or more lamp modules.

Figure 7:
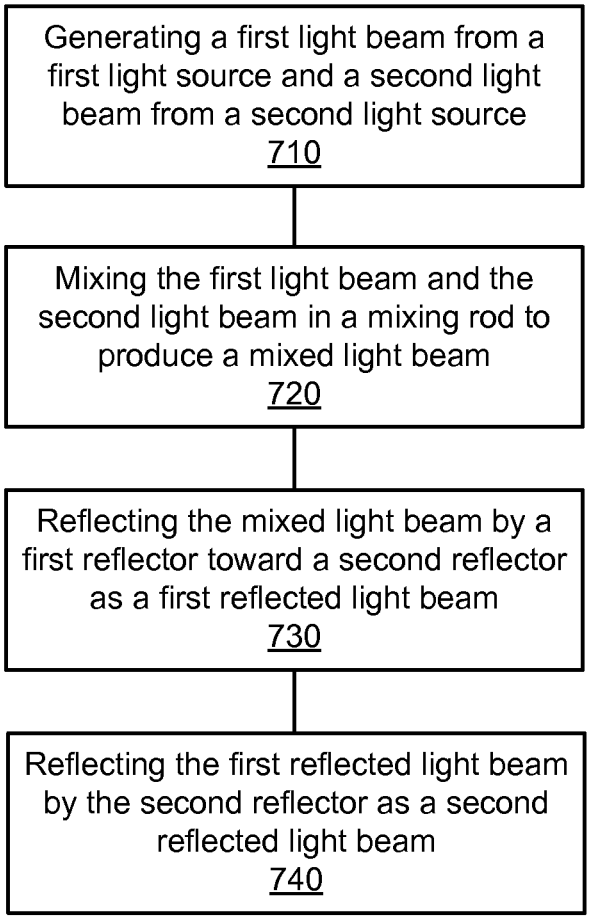
FIG. 7 is a flowchart of an exemplary method under the present invention.

FIG. 7 is a flow chart of an exemplary method for mixing and folding light from a plurality of light sources in an operatory lighting device. It should be noted that any process descriptions or blocks in flow charts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by a person reasonably skilled in the art of the present invention.

As shown by block 710, a step of the exemplary method includes generating a first light beam from a first light source and a second light beam from a second light source. For example, the first light beam may be a first colored light produced by a first LED, and the second light beam may be a second colored light produced by a second LED. A step includes mixing the first light beam and the second light beam in a light mixing rod to produce a mixed light beam, as shown by block 720.

A step includes reflecting the mixed light beam by a first reflector toward a second reflector as a first reflected light beam, as shown by block 730. The first reflector may have a flat reflecting surface, a concave reflecting surface, or a convex reflecting surface, for example, a mirror. The first reflector may have a smooth or irregular reflecting surface. The first reflector may be positioned at or near a focal point of the second reflector. The first reflector may have a fixed position relative to the second reflector, or may be movable to be positioned at a range of distances from the second reflector, for example, to change the dispersion pattern of the first reflected beam.

A step includes reflecting the first reflected light beam by the second reflector as a second reflected light beam, as shown by block 740. The second reflected light beam may be directed in a substantially similar direction to the mixed light beam, and substantially opposite from the direction of the first reflected light beam. The dispersion pattern of the second reflected beam is generally the same shape as the dispersion pattern of the mixed light beam, but is generally larger, and may be affected by the reflecting surface of the second reflector, for example, the shape of the second reflector, and/or if the reflecting surface of the second reflector is substantially smooth or irregular. The shape of the dispersion pattern of the mixed beam may be largely determined by the shape of the egress end of the mixing rod.

Figure 8:
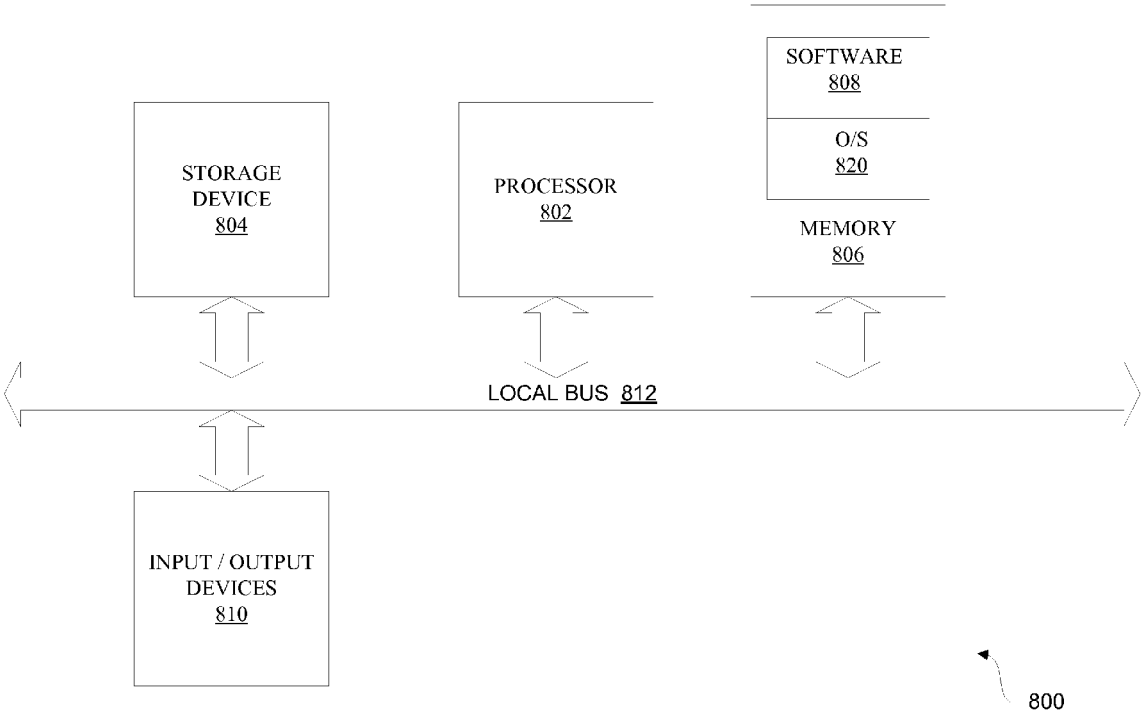
FIG. 8 is a schematic diagram illustrating an example of a system for executing functionality of the present invention.

As previously mentioned, the present system for executing the functionality described in detail above may be a processor or computer, an example of which is shown in the schematic diagram of FIG. 8. The system 800 contains a processor 802, a storage device 804, a memory 806 having software 808 stored therein that defines the abovementioned functionality, input and output (I/O) devices 810 (or peripherals), and a local bus, or local interface 812 allowing for communication within the system 800. The local interface 812 can be, for example but not limited to, one or more buses or other wired or wireless connections, as is known in the art. The local interface 812 may have additional elements, which are omitted for simplicity, such as controllers, buffers (caches), drivers, repeaters, and receivers, to enable communications. Further, the local interface 812 may include address, control, and/or data connections to enable appropriate communications among the aforementioned components.

The processor 802 is a hardware device for executing software, particularly that stored in the memory 806. The processor 802 can be any custom made or commercially available single core or multi-core processor, a central processing unit (CPU), an auxiliary processor among several processors associated with the present system 800, a semiconductor based microprocessor (in the form of a microchip or chip set), a macroprocessor, or generally any device for executing software instructions.

The memory 806 can include any one or combination of volatile memory elements (e.g., random access memory (RAM, such as DRAM, SRAM, SDRAM, etc.)) and nonvolatile memory elements (e.g., ROM, hard drive, tape, CDROM, etc.). Moreover, the memory 806 may incorporate electronic, magnetic, optical, and/or other types of storage media. Note that the memory 806 can have a distributed architecture, where various components are situated remotely from one another, but can be accessed by the processor 802.

The software 808 defines functionality performed by the system 800, in accordance with the present invention. The software 808 in the memory 806 may include one or more separate programs, each of which contains an ordered listing of executable instructions for implementing logical functions of the system 800, as described below. The memory 806 may contain an operating system (O/S) 820. The operating system essentially controls the execution of programs within the system 800 and provides scheduling, input-output control, file and data management, memory management, and communication control and related services.

The I/O devices 810 may include input devices, for example but not limited to, a keyboard, mouse, scanner, microphone, etc. Furthermore, the I/O devices 810 may also include output devices, for example but not limited to, a printer, display, etc. Finally, the I/O devices 810 may further include devices that communicate via both inputs and outputs, for instance but not limited to, a modulator/demodulator (modem; for accessing another device, system, or network), a radio frequency (RF) or other transceiver, a telephonic interface, a bridge, a router, or other device.

When the system 800 is in operation, the processor 802 is configured to execute the software 808 stored within the memory 806, to communicate data to and from the memory 806, and to generally control operations of the system 800 pursuant to the software 808, as explained above. In summary, a lamp has been presented that mixes multiple light sources together and folds the resulting mixed light to produce a light beam with controllable intensity and color temperature. The lamp is advantageous over the prior art by positioning of the heat generating elements away from the subject being illuminated, simplifying heat dissipation and resulting in less bulk and a smaller size. Positioning the light sources in the back of the lamp also removes the need to conduct electrical power to the front portion of the lamp, thereby further reducing costs.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A lamp for illuminating a target subject, comprising:

a lamp base;

a bracket associated with the lamp base;

a light mixing rod comprising an ingress end having a first shape and an egress end having a second shape;

an assembly mounted to the bracket comprising a plurality of light sources in optical communication with said light mixing rod ingress end;

a first reflector comprising a first diameter in optical communication with said light mixing rod egress end; and a second reflector comprising a second diameter in optical communication with said first reflector, wherein said light mixing rod egress end is disposed substantially between said first reflector and said second reflector, said light mixing rod is configured to mix light from said plurality of light sources, and said first reflector is configured to receive light rays emanating from said egress end of said light mixing rod egress end.

2. The lamp of claim 1, wherein said plurality of light sources comprises an LED.

3. The lamp of claim 1, wherein said first reflector is substantially opposite said second reflector.

4. The lamp of claim 3, wherein said second reflector further comprises a substantially concave reflecting surface.

5. The lamp of claim 4, wherein said first reflector further comprises a reflecting surface having a shape selected from the group consisting of convex, flat, and concave.

6. The lamp of claim 4, wherein said substantially concave reflecting surface is substantially aspherical in shape.

7. The lamp of claim 3, wherein said second reflector further comprises a centrally located aperture, and said light mixing rod is disposed at least partially within said aperture.

8. The lamp of claim 6, wherein said first reflector is disposed substantially at a focal point of said second reflector.

9. The lamp of claim 1, wherein a first light source of said plurality of light sources produces light comprising a first color, and a second light source of said plurality of light sources produces light comprising a second color.

10. The lamp of claim 1, wherein said first shape is different from said second shape.

11. The lamp of claim 1, wherein said first shape is substantially similar to said second shape.

12. The lamp of claim 1, further comprising a controller in electrical communication with said assembly configured to control a lighting parameter of at least one of said light sources.

13. The lamp of claim 12, wherein said lighting parameter comprises intensity.

14. The lamp of claim 1, wherein said second diameter is larger than said first diameter.

15. The lamp of claim 1, wherein said light mixing rod, said first reflector, and said second reflector are each configured to be disposed substantially between said assembly and said target subject.

16. A method for mixing and folding light for illuminating a target subject from a plurality of light sources, comprising the steps of:

generating a first light beam from a first light source and a second light beam from a second light source;

mixing said first light beam and said second light beam in a light mixing rod to produce a mixed light beam;

receiving by a first reflector said mixed light beam from an egress end of said light mixing rod;

reflecting said mixed light beam by the first reflector toward a second reflector as a first reflected light beam; and reflecting said first reflected light beam by said second reflector as a second reflected light beam.

17. The method of claim 16, further comprising the step of directing said first light beam and said second light beam into an ingress end of said light mixing rod.

18. The method of claim 16, wherein said second reflected light beam is directed in a substantially similar direction to said mixed light beam.

19. The method of claim 16, further comprising the step of controlling at least one lighting parameter of said first light beam.

20. The method of claim 19, wherein said at least one lighting parameter comprises intensity.

21. The method of claim 19, wherein said at least one lighting parameter comprises color.

22. The method of claim 16, wherein said light mixing rod, said first reflector, and said second reflector are each configured to be disposed substantially between said lamp and said target subject.

* * * * *